US005665041A

United States Patent [19]

Hsieh

[11] Patent Number: 5,665,041

[45] Date of Patent: Sep. 9, 1997

[54] ABDOMINAL EXERCISER

[75] Inventor: Yi Fong Hsieh, Succasunna, N.J.

[73] Assignee: LifeGear, Inc., Rockaway Township, Morris County, N.J.

[21] Appl. No.: 775,456

[22] Filed: Dec. 30, 1996

[51] Int. Cl.[6] ..... A63B 23/02

[52] U.S. Cl. ..... 482/140; 482/95; 482/123; 482/133; 482/142

[58] Field of Search ..... 482/42, 92, 95, 482/96, 121–123, 129–133, 135–140, 142, 148, 908; 297/68, 75, 90, 91; 601/23, 24, 26

[56] References Cited

U.S. PATENT DOCUMENTS

| | | | |
|---|---|---|---|
| Re. 26,725 | 11/1969 | Sellner | 482/142 |
| 4,729,562 | 3/1988 | Pipasik | 482/137 |
| 5,100,131 | 3/1992 | Fong . | |
| 5,215,511 | 6/1993 | Cheng . | |
| 5,300,005 | 4/1994 | Wang . | |
| 5,308,306 | 5/1994 | Wang . | |
| 5,468,216 | 11/1995 | Johnson et al. | 601/24 |
| 5,531,658 | 7/1996 | L.S.C. | 482/142 |
| 5,542,898 | 8/1996 | Wilkinson . | |
| 5,545,114 | 8/1996 | Gvoich . | |
| 5,601,519 | 2/1997 | Comereski | 601/24 |

*Primary Examiner*—Jeanne M. Clark
*Attorney, Agent, or Firm*—David L. Davis

[57] ABSTRACT

Abdominal exercise apparatus wherein upper and lower body supports are provided and interconnected to coordinate upper and lower abdominal workouts. Resistance for the abdominal exercises may also be provided by the apparatus. Further, the interconnection between the upper and lower body supports may be selectively disconnected so that individual upper and lower abdominal exercises can be performed.

13 Claims, 6 Drawing Sheets

ABDOMINAL EXERCISER

BACKGROUND OF THE INVENTION

This invention relates to exercise apparatus and, more particularly, to abdominal exercise apparatus wherein interconnected upper and lower body supports are provided.

In recent years, people have become increasingly interested in physical fitness, particularly in muscular body toning. One area of the body that has received increasing attention is the abdomen, and numerous types of abdominal exercise apparatus have been developed and marketed. However, none of the known apparatus forces the user to partake simultaneously of both upper and lower body movements. It is therefore an object of this invention to provide abdominal exercise apparatus wherein coordinated upper and lower body movements are effected.

It is another object of this invention to provide such abdominal exercise apparatus wherein resistance to body movement is provided by the apparatus.

SUMMARY OF THE INVENTION

The foregoing and additional objects are attained in accordance with the principles of this invention by providing abdominal exercise apparatus comprising a base member adapted for support on a substantially horizontal surface and a generally planar seat pad disposed generally horizontally on the base member. A foot support assembly is pivotably mounted to the base member about a first horizontal pivot axis at a first side of the seat pad and a back support assembly is pivotally mounted to the base member about a second horizontal pivot axis parallel to the first pivot axis and across the seat pad from the foot support assembly. Interconnection means are provided for interconnecting the foot support assembly and the back support assembly for concurrent pivoting movement in opposite angular directions about their respective pivot axes.

In accordance with an aspect of this invention, the apparatus further comprises resistance means coupled between the base member and the interconnection means for providing resistance to movement of the foot support assembly and the back support assembly.

In accordance with another aspect of this invention, the interconnection means includes first, second and third link bars. The first link bar has first and second ends and is pivotably mounted between its first and second ends to the base member about a third horizontal pivot axis parallel to and between the first and second pivot axes. The second link bar has first and second ends and is pivotably mounted at its first end to the first end of the first link bar and at its second end to the foot support assembly. The third link bar has first and second ends and is pivotably mounted at its first end to the second end of the first link bar and at its second end to the back support assembly.

In accordance with a further aspect of this invention, the foot support assembly includes a first member extending away from the first pivot axis to a first side of a plane containing the first and second pivot axes and the back support assembly includes a second member extending away from the second pivot axis to the other side of the plane. The interconnection means includes a link bar having first and second ends. The link bar passes through the plane and is pivotably mounted at its first end to the first member and at its second end to the second member.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
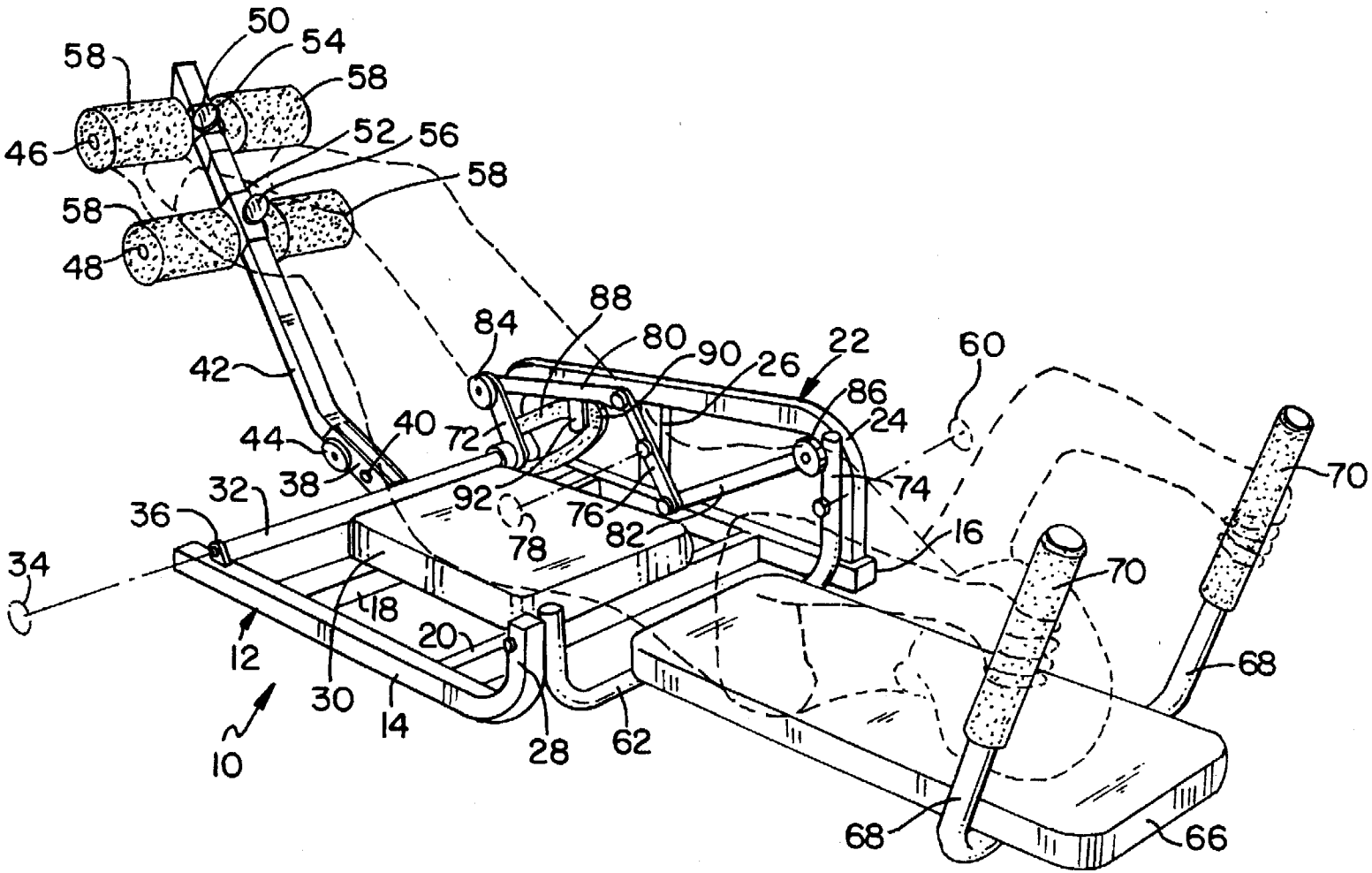
FIG. 1 is a perspective view of a first illustrative embodiment of abdominal exercise apparatus constructed in accordance with the principles of this invention showing, in phantom, a user disposed thereon.
Figure 2:
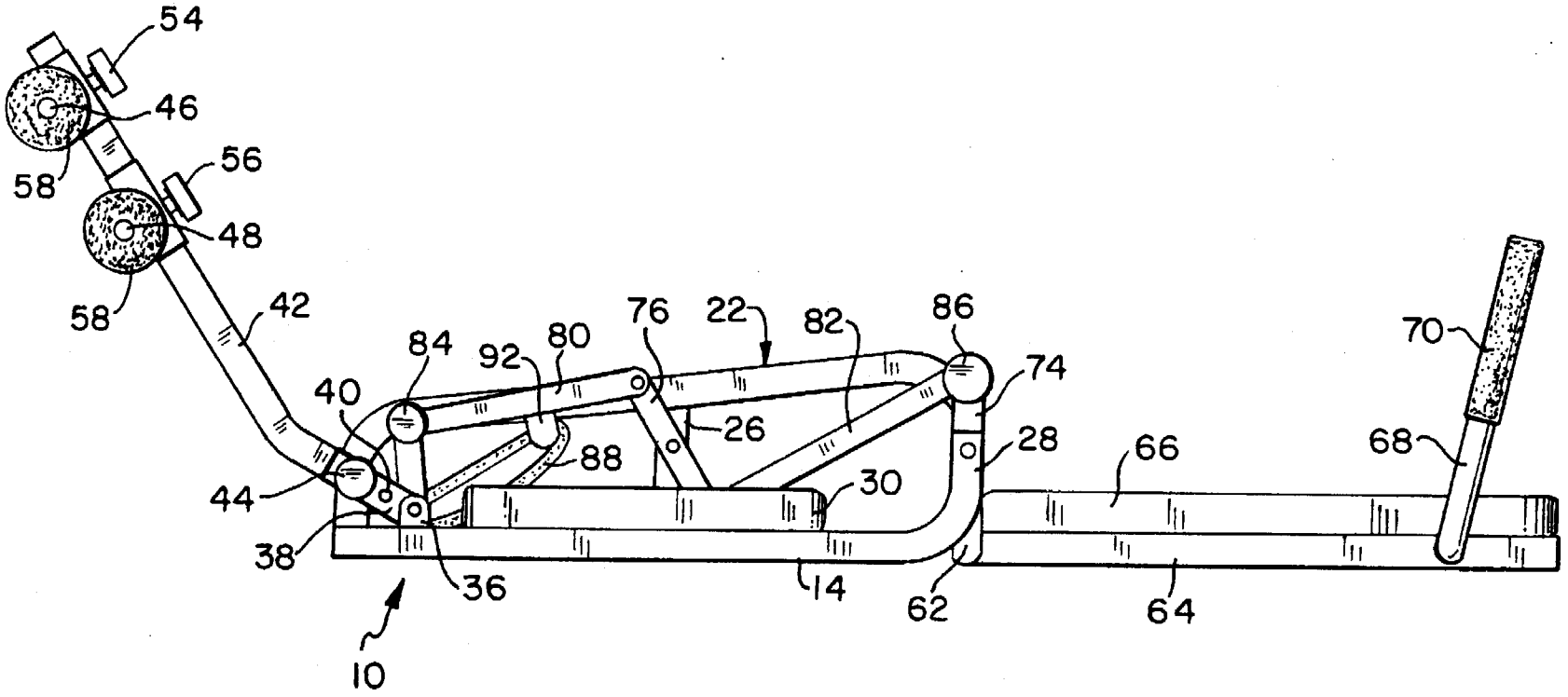
FIG. 2 is a side elevational view of the apparatus of FIG. 1 shown in its rest position.
Figure 3:
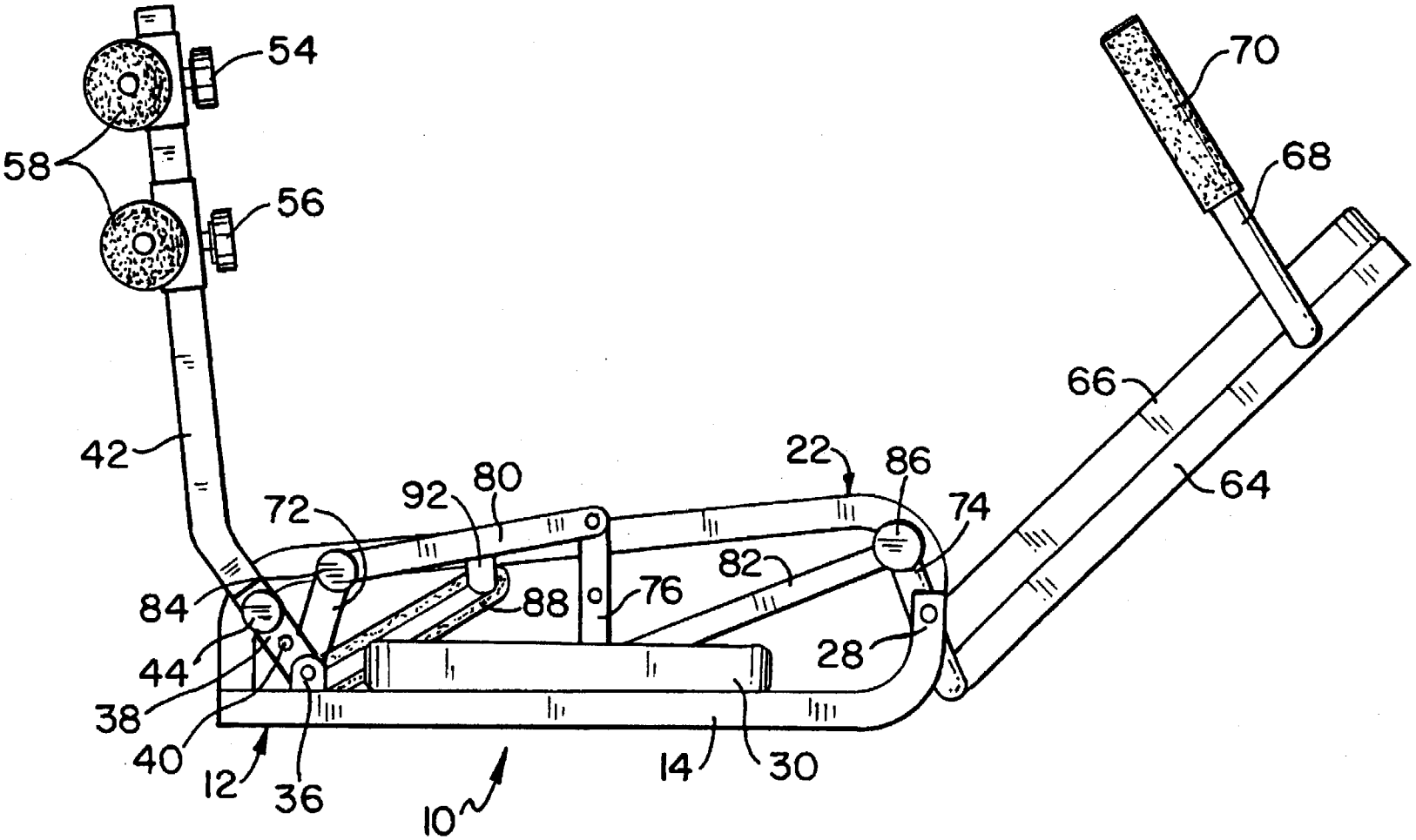
FIG. 3 is a side elevational view of the apparatus of FIG. 1 shown in its extended position.

Referring now to the drawings, FIGS. 1–3 illustrate a first exemplary abdominal exercise apparatus, designated generally by the reference numeral 10 and constructed in accordance with the principles of this invention. As shown in FIG. 1, the apparatus 10 includes a base member 12 which is adapted for support on a substantially horizontal surface, such as a floor. The base member 12 is illustratively a frame having a side piece 14, a side piece 16, and a pair of transverse members 18, 20 secured to the side pieces 14, 16, so as to define a support plane for the apparatus 10. A side frame 22 is secured to the side piece 16 and extends upwardly therefrom. The side frame 22 includes a downwardly open generally C-shaped member 24 secured at its ends to opposite ends of the side piece 16 and a generally vertical central support member 26 secured at its lower end to the side piece 16 substantially centrally thereof and at its upper end to the C-shaped member 24. The side piece 14 has an end portion 28 extending vertically upward from one end of the side piece 14. A generally planar seat pad 30 is secured to the transverse members 18, 20 of the base member 12 so as to be disposed generally horizontally thereon.

A first elongated member, or tube, 32 is journalled for rotation about a first horizontal pivot axis 34 extending between a boss 36 secured to the side piece 14 and the C-shaped member 24 at a first side of the seat pad 30. Secured to the tube 32 for rotation therewith is a foot support assembly including a channel member 38. Pivotably disposed in the channel member 38, about an axis 40, is an elongated and obtusely angled foot support member 42. The foot support member 42 is prevented from pivoting within the channel member 38 by a rod (not shown) secured to a knob 44 and extending through suitably aligned openings in the channel member 38 and the foot support member 42. At the distal end of the foot support member 42 there is slidably mounted a pair of foot support bars 46, 48. Each of the foot support bars 46, 48 is secured to a respective channel member 50, 52, slidable along the foot support member 42 and which may be secured at respective desired locations by means of respective knobs 54, 56 secured to threaded rods extending through suitable threaded openings in the channel members 50, 52 for frictional engagement with a surface of the foot support member 42. The bars 46, 48 extend substantially equally on both sides of the foot support member 42 and each side of each of the foot support bars 46, 48 is covered by a respective one of four cushions 58.

Across the seat pad 30 from the first pivot axis 34, a second horizontal pivot axis 60 parallel to the first pivot axis 34 is defined between the end portion 28 of the side piece 14 and the C-shaped member 24. A generally U-shaped member 62 is pivotably mounted about the second pivot axis 60 to the end portion 28 of the side piece 14 and the C-shaped member 24. This U-shaped member 62 forms a part of a back support assembly which further includes an elongated member 64 secured at one end to the closed end of the U-shaped member 62 and extending orthogonally to the pivot axis 60. A back pad 66 is secured to the elongated member 64 and a pair of handgrips 68, each covered by a cushion 70 at its distal end, are secured to the elongated member 64 and extend on opposite sides of the back pad 66.

An interconnection mechanism is provided for interconnecting the foot support assembly and the back support assembly for concurrent pivoting movement in opposite angular directions about the respective pivot axes 34, 60. To effect such interconnection, the foot support assembly includes a member 72 secured to the tube 32 adjacent the side frame 22 and extending upwardly from the tube 32 so as to pivot with the tube 32 about the pivot axis 34. The U-shaped member 62 is formed with an extension 74 beyond the pivot axis 60 and adjacent the side frame 22. A first link bar 76 is pivotably mounted to the central support member 26 about a third horizontal pivot axis 78 parallel to the first and second pivot axes 34, 60. The link bar 76 has two ends and is pivotably mounted substantially centrally between those ends. A second link bar 80 is provided which is pivotably mounted at a first of its ends to a first end of the first link bar 76 and at its second end to the member 72. A third link bar 82 is provided which is pivotably mounted at a first of its ends to the second end of the first link bar 76 and at its second end to the extension 74. The connection between the link bar 80 and the member 72 and the connection between the link bar 82 and the extension 74 are selectively removable, as indicated by the respective knobs 84, 86, so that individual upper and lower abdominal exercises can be performed.

To provide resistance, an elastic band 88 is coupled at a first end 90 to the link bar 80 via an extension 92 and at a second end to the side frame 22. Although an elastic band is illustrated, other resistance elements, such as pneumatic or hydraulic cylinders, can alternatively be used to provide resistance.

To use the apparatus 10, the user places his buttocks on the seat pad 30 and lies back against the back pad 66. The user then places his ankles between vertically separated cushions 58 of the foot support assembly, with his feet on the other side of the upper cushion 58 from his body. The user then grasps the cushions 70 of the handgrips 68. In the rest position of the apparatus 10, as shown in FIG. 2, the back pad 66 is substantially coplanar with the seat pad 30 and the elastic band 88 is slack. When the user wishes to tense his abdominal muscles, using the handgrips 68 and the foot support bars 46, 48, the apparatus 10 is moved into its extended position, as shown in FIG. 3, by pivoting the foot support assembly clockwise, as viewed in FIG. 3, about the pivot axis 34 and pivoting the back support assembly counterclockwise about the pivot axis 60. This stretches the elastic band 88 to provide resistance to such movement.

Using the knobs 84, 86, the user can disconnect the foot support assembly from the back support assembly, if so desired, so that upper and lower abdominal workouts can be individually performed, rather than in a combined manner when the foot support assembly and the back support assembly are interconnected.

Figure 4:
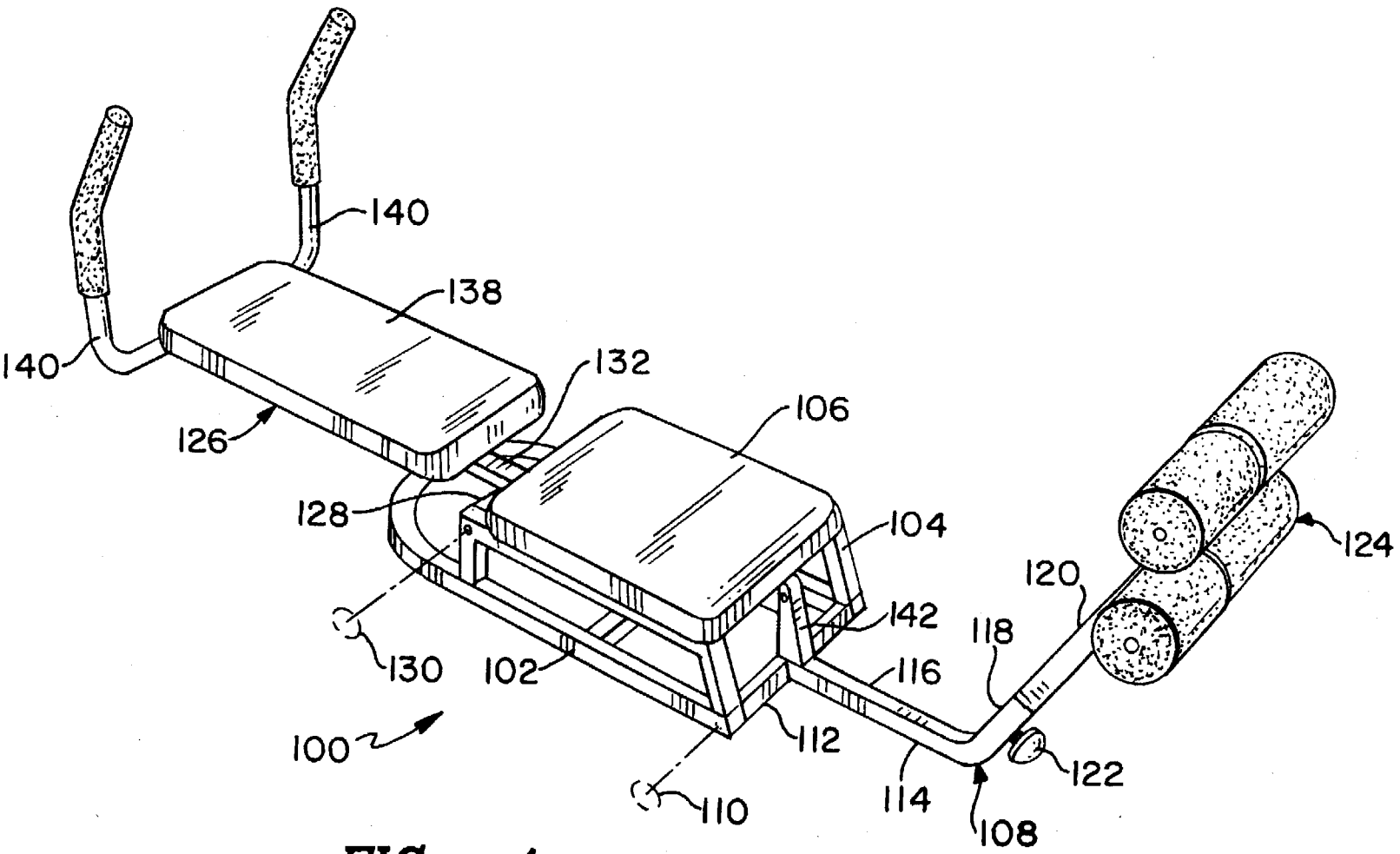
FIG. 4 is a perspective view of a second illustrative embodiment of abdominal exercise apparatus constructed in accordance with the principles of this invention.
Figure 5:
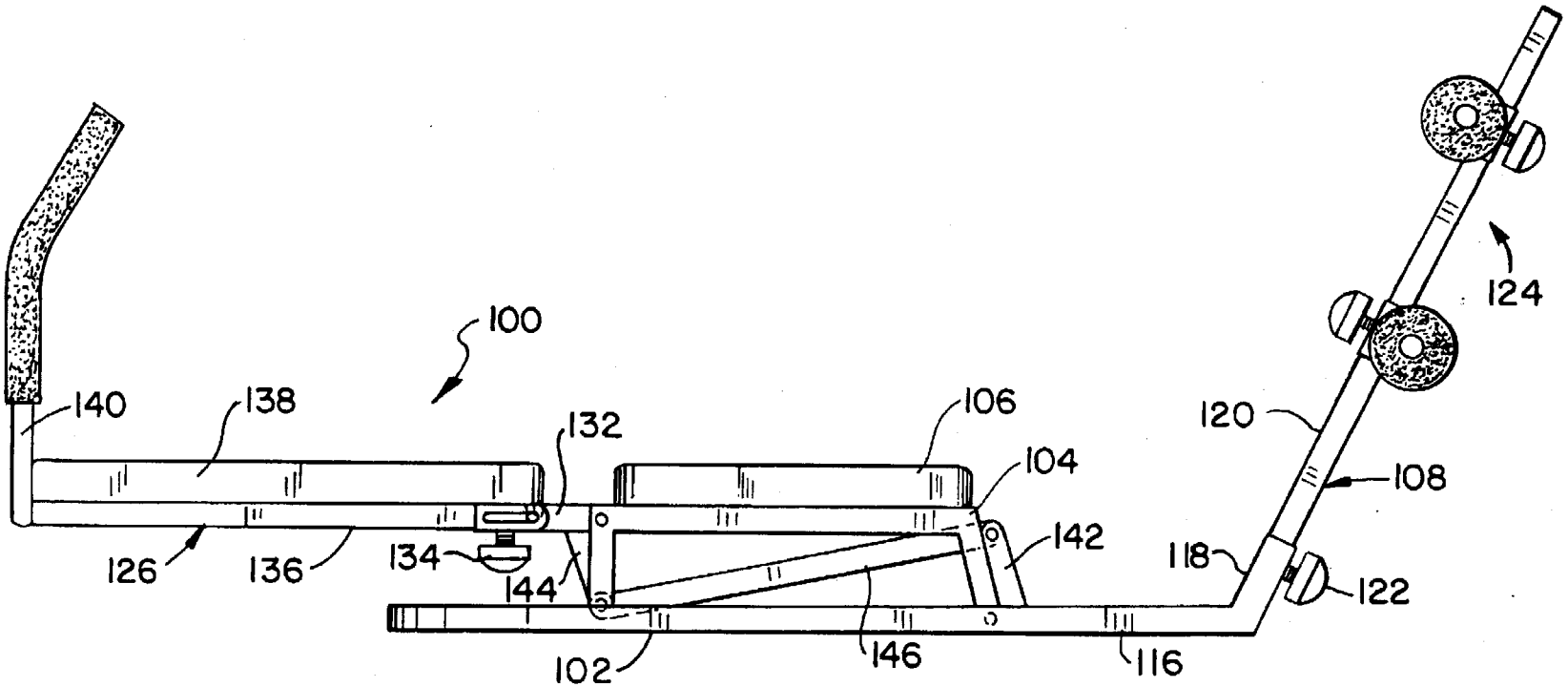
FIG. 5 is a side elevational view of the apparatus of FIG. 4 shown in its rest position.
Figure 6:
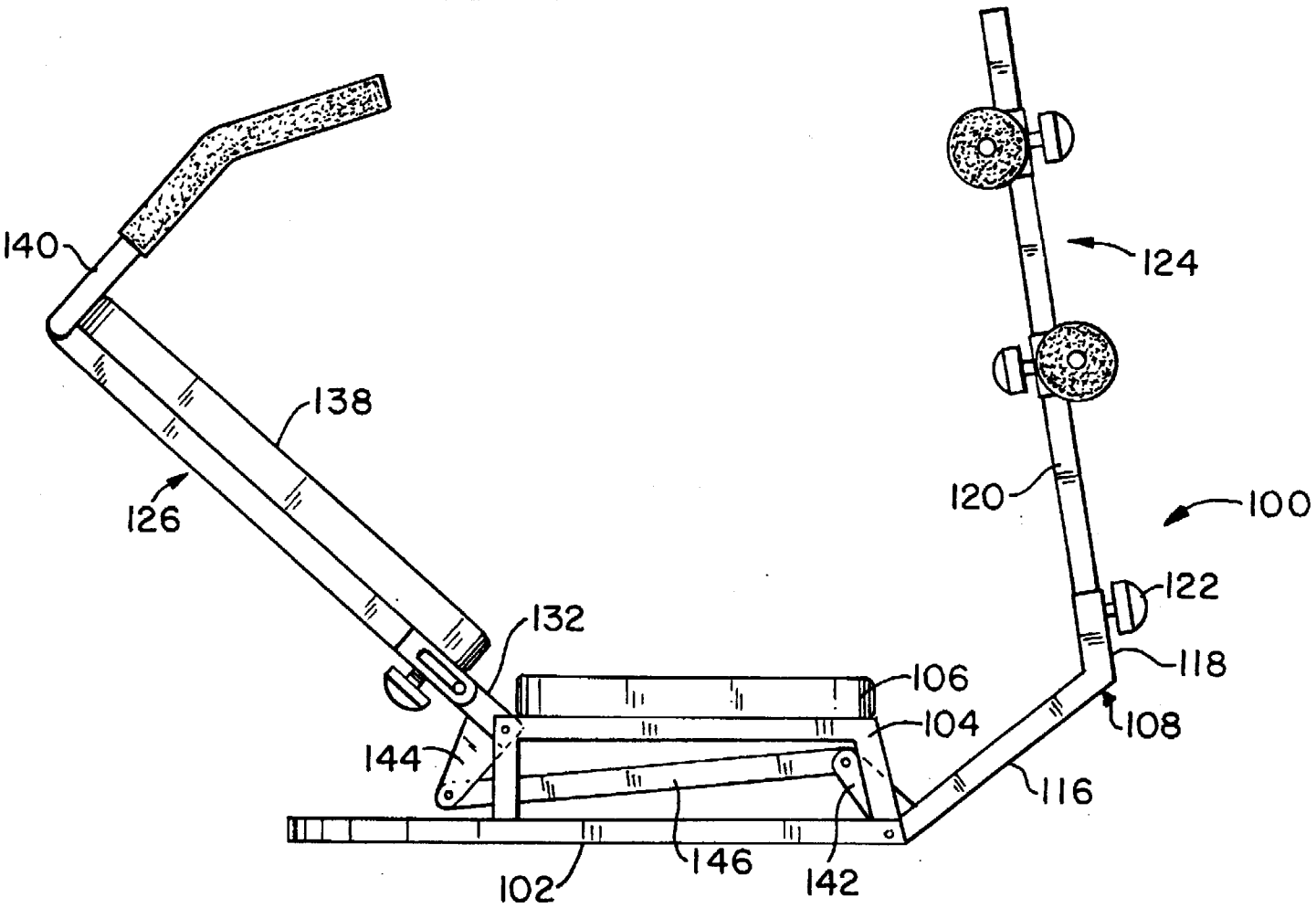
FIG. 6 is a side elevational view of the apparatus of FIG. 4 shown in its extended position.

FIGS. 4–6 illustrate a second exemplary abdominal exercise apparatus, designated generally by the reference numeral 100 and constructed in accordance with the principles of this invention. The apparatus 100 includes a base member 102 which is adapted for support on a substantially horizontal surface, such as a floor. As shown, the base member 102 may be a substantially U-shaped frame supporting an upwardly extending seat support frame 104 which defines a generally horizontal seat pad support plane on which is disposed the seat pad 106. A foot support assembly 108 is pivotably mounted to the base member 102 about a first horizontal pivot axis 110 at a first side of the support frame 104. Thus, an elongated member 112 is journalled for rotation between the sides of the base member 102 about the pivot axis 110, with the longitudinal axis of the member 112 being colinear with the pivot axis 110. Secured to the elongated member 112 is a member 114 having a first straight portion 116 and a second straight portion 118 connected at an obtuse angle. The first straight portion 116 is secured at its end remote from the second straight portion 118 to the elongated member 112 and, as shown in FIG. 5, is adapted to rest on the horizontal surface as a limit when the foot support assembly 110 is pivoted away from the seat support frame 104. The foot support assembly 108 further includes an elongated member 120 slidably secured with respect to the second straight portion 118 by means of the knob 122 and which carries at its ends foot support means 124 including adjustable foot support bars and cushions, substantially the same as those described with respect to the embodiment shown in FIGS. 1–3.

A back support assembly 126 includes an elongated member 128 pivotably mounted to the seat support frame 104 about a second horizontal pivot axis 130 parallel to and above the pivot axis 110 and across the seat support frame 104 from the foot support assembly 108. Secured to the elongated member 128 for pivoting movement therewith is a member 132 having slidably secured therein, for adjustment purposes via the knob 134, an elongated member 136 on which is disposed a generally planar back pad 138 supported in a plane parallel to the pivot axis 130. A pair of cushion covered handgrips 140 are secured to the elongated member 136 and extend outwardly from opposite sides of the back pad 138.

To interconnect the foot support assembly 108 and the back support assembly 126 for concurrent pivoting movement in opposite angular directions about their respective pivot axes 110, 130, the foot support assembly 108 has a member 142 extending upwardly from the pivot axis 110 and secured to the straight portion 116 and the elongated member 112. The back support assembly 126 includes a member 144 extending downwardly from the pivot axis 110 and secured to the member 132 and the elongated member 128. A link bar 146 is pivotably mounted at a first of its ends to the member 142 of the foot support assembly 108 and at its second end Go the member 144 of the back support assembly 126. Thus, if one imagines a plane containing the pivot axes 110 and 130, the member 142 extends from the pivot axis 110 to a first side of the plane, the member 144 extends from the second pivot axis 130 to the other side of the plane, and the link bar 146 passes through the plane.

As shown in FIG. 5, when the apparatus 110 is in its rest position, the first straight portion 116 of the foot support assembly 108 rests on the horizontal surface. The lengths of the members 142 and 144 and the link bar 146, as well as the mounting of the back pad 138, are selected so that the back pad 138 is generally horizontal and coplanar with the seat pad 106 when the apparatus 100 is in its rest position. When the user moves the apparatus to its extended position, as shown in FIG. 6, the foot support assembly 108 and the back support assembly 126 move concurrently in opposite angular directions about their respective pivot axes. While not shown in FIGS. 4–6, the apparatus 100 can include resistance means like that shown for the apparatus 10 (FIGS. 1–3). Such resistance means could include a similar elastic band coupled between the base member 102 or the support frame 104 and the member 142 or the member 144.

Accordingly, there has been disclosed abdominal exercise apparatus wherein interconnected upper and lower body supports are provided. While exemplary embodiments of apparatus constructed in accordance with the principles of this invention have been disclosed, it is understood that various modifications and adaptations to the disclosed embodiments will be apparent to one of skill in the art and it therefore intended that this invention be limited only by the scope of the appended claims.

What is claimed is:

1. Abdominal exercise apparatus comprising:

a base member adapted for support on a substantially horizontal surface;

a generally planar seat pad fixed disposed generally horizontally on said base member;

a foot support assembly pivotably mounted to said base member about a first horizontal pivot axis at a first side of said seat pad;

a back support assembly pivotably mounted to said base member about a second horizontal pivot axis parallel to said first pivot axis and across said seat pad from said foot support assembly, wherein in its at rest position said back support assembly is substantially horizontal and line with said seat pad;

interconnection means interconnecting said foot support assembly and said back support assembly for concurrent pivoting movement in opposite angular directions about their respective pivot axes;

wherein one said foot support assembly and said back support assembly is configured to be directly disposed on the substantially horizontal surface in the at rest position of said apparatus; and whereby a user lyes in a supine position with his/her feet positioned on said foot support assembly and his/her back position on said back support assembly, and performs abdominal exercises.

2. The apparatus according to claim 1 wherein said back support assembly includes a back pad and a pair of handgrips extending from opposite sides of said back pad.

3. The apparatus according to claim 1 wherein said interconnection means includes:

a first link bar having first and second ends and being pivotably mounted between said first and second ends to said base member about a third horizontal pivot axis parallel to and between said first and second pivot axes;

a second link bar having first and second ends and being pivotably mounted at its first end to the first end of said first link bar and at its second end to said foot support assembly; and a third link bar having first and second ends and being pivotably mounted at its first end to the second end of said first link bar and at its second end to said back support assembly.

4. The apparatus according to claim 1 further comprising resistance means coupled between said base member and said interconnection means for providing resistance to movement of said foot support assembly and said back support assembly.

5. The apparatus according to claim 1 wherein said foot support assembly comprises:

a first elongated member pivotably mounted to said base member along said first pivot axis;

a second elongated member secured to said first elongated member and extending orthogonally to said first pivot axis; and foot support means secured to the distal end of said second elongated member.

6. The apparatus according to claim 5 wherein said foot support means comprises:

a first foot support bar;

a second foot support bar;

first mounting means for mounting said first foot support bar to the distal end of said second elongated member with said first foot support bar parallel to said first axis and extending substantially equally from both sides of said second elongated member; and second mounting means for mounting said second foot support bar to said second elongated member with said second foot support bar spaced from said first foot support bar, parallel to said first axis and extending substantially equally from both sides of said second elongated member.

7. The apparatus according to claim 6 wherein:

said first mounting means is slidable along said second elongated member and includes means for securing said first mounting means to a user desired position along said second elongated member; and said second mounting means is slidable along said second elongated member and includes means for securing said second mounting means to a user desired position along said second elongated member.

8. The apparatus according to claim 6 wherein said foot support means further includes four cushions each adapted to cover a respective extending portion of said first and second foot support bars.

9. The apparatus according to claim 1 wherein:

said foot support assembly includes a first member extending away from said first pivot axis to a first side of a plane containing said first and second pivot axes;

said back support assembly includes a second member extending away from said second pivot axis to the other side of said plane; and said interconnection means includes a link bar having first and second ends, said link bar passing through said plane and being pivotably mounted at its first end to said first member and at its second end to said second member.

10. Abdominal exercise apparatus comprising:

a base member adapted for support on a substantially horizontal surface;

a generally planar seat pad fixedly disposed generally horizontally on said base member;

a side frame secured along one edge of said base member and extending upwardly therefrom;

a foot support assembly pivotably mounted to said base member at a first horizontal pivot axis transverse to said one edge and at a first side of said seat pad, said foot support assembly including a first member adjacent to said side frame and extending upwardly from said first pivot axis;

a back support assembly pivotably mounted to said base member at a second horizontal pivot axis parallel to said first pivot axis and across said seat pad from said foot support assembly, said back support assembly including a second member adjacent to said side frame and extending upwardly from said second pivot axis;

a first link bar having first and second ends and being pivotably mounted between its first and second ends to said side frame at a third horizontal pivot axis parallel to and between said first and second pivot axes;

a second link bar having first and second ends and being pivotably mounted at its first end to the first end of said first link bar and at its second end to said foot support assembly first member; and a third link bar having first and second ends and being pivotably mounted at its first end to the second end of said first link bar and at its second end to said back support assembly second member whereby a user lyes in a supine position with his/her feet positioned on said foot support assembly and his/her back positioned on said back support assembly, and performs abdominal exercises.

11. The apparatus according to claim 10 wherein said back support assembly includes:

a U-shaped member having its closed end substantially parallel to said second pivot axis;

an elongated member fixedly secured to the closed end of said U-shaped member and adapted to rest horizontally on the horizontal surface as a limit when said back support assembly is pivoted away from said seat pad; and a generally planar back pad supported on said elongated member in a plane parallel to said second pivot axis.

12. Abdominal exercise apparatus comprising:

a base member adapted for support on a substantially horizontal surface;

a seat support frame secured to said base member and extending upwardly therefrom to define a generally horizontal seat pad support plane;

a generally planar seat pad fixedly supported on said seat support frame at said seat support plane;

a foot support assembly pivotably mounted to said base member about a first horizontal pivot axis at a first side of said seat support frame, said foot support assembly including a first member extending upwardly from said first pivot axis;

a back support assembly pivotably mounted to said seat support frame about a second horizontal pivot axis parallel to and above said first pivot axis and across said seat support frame from said foot support assembly, said back support assembly including a second member extending downwardly from said second pivot axis; and a link bar having first and second ends and being pivotably mounted at its first end to said foot support assembly first member and at its second end to said back support assembly second member whereby a user lyes in a supine position with his/her feet positioned on said foot support assembly and his/her back positioned on said back support assembly, and performs abdominal exercises.

13. The apparatus according to claim 12 wherein:

said foot support assembly includes a member having first and second straight portions connected at an obtuse angle, said member being mounted at an end of one of said portions to pivot about said first pivot axis and adapted to have said one portion rest on the horizontal surface as a limit when said foot support assembly is pivoted away from said seat support frame;

said back support assembly includes a generally planar back pad supported in a plane parallel to said second pivot axis; and the lengths of said first and second members and said link bar and the mounting of said back pad are selected so that said back pad is generally horizontal and coplanar with said seat pad when said one portion of said foot support assembly member rests on the horizontal surface.

* * * * *